US008737909B2

(12) United States Patent
Kolinko et al.

(10) Patent No.: US 8,737,909 B2
(45) Date of Patent: May 27, 2014

(54) DIGITAL PROCESSING FOR CO-SITE INTERFERENCE MITIGATION

(76) Inventors: Vladimir Kolinko, San Diego, CA (US); Paul Johnson, El Cajon, CA (US); Alex Shek, San Diego, CA (US)

( * ) Notice: Subject to any disclaimer, the term of this patent is extended or adjusted under 35 U.S.C. 154(b) by 590 days.

(21) Appl. No.: 12/930,616

(22) Filed: Jan. 12, 2011

(65) Prior Publication Data

US 2012/0252349 A1 Oct. 4, 2012

Related U.S. Application Data

(60) Provisional application No. 61/335,865, filed on Jan. 12, 2010.

(51) Int. Cl.
*H04K 3/00* (2006.01)

(52) U.S. Cl.
USPC ..... 455/1

(58) Field of Classification Search
None
See application file for complete search history.

(56) References Cited

U.S. PATENT DOCUMENTS 3,953,851 A * 4/1976 Weidstam ..... 342/14
2003/0054755 A1* 3/2003 Zehavi et al. ..... 455/1

* cited by examiner

*Primary Examiner* — Philip Sobutka
(74) *Attorney, Agent, or Firm* — John R. Ross

(57) ABSTRACT

A radio system providing long-range radio communications in the presence of a co-located high power jammer or other radio transmitter that is operating in a frequency band overlapping the communications transmit/receive band. The system collects sample signals from co-located overlapping radio. It down-converts the sample signal and the receive radio signal, digitizes the two signals, and utilizes a computer processor to cancel the sample signal from the receive radio signal to output a mitigated output signal.

10 Claims, 14 Drawing Sheets

RF component of the 1st embodiment of the jammer leakage noise cancellation circuit

DIGITAL PROCESSING FOR CO-SITE INTERFERENCE MITIGATION

CROSS REFERENCE TO RELATED APPLICATIONS

This application claims the benefit of Provisional Patent Application Ser. No. 61/335,865 filed Jan. 12, 2010.

FEDERALLY SPONSORED RESEARCH

The present invention was made in the course of performance of work under Contract No. W31P4Q-05-C-0295 with the Defense Threat Reduction Agency and the United States Government has rights in the invention.

FIELD OF INVENTION

The present invention relates to radio systems and in particular to radios designed to avoid interference.

BACKGROUND OF THE INVENTION

Radio Jammers

In some radio jamming applications a wide bandwidth radio noise signal is transmitted at a high power level, which prevents the reception of communication signals by overwhelming the communications signal(s) at the receiver. It is often desirable to maintain ones own communications through the jamming signal, while simultaneously jamming others, even in the same general frequency bands. If the jamming signal source is close to one's own communications receiver, this task can be very difficult. In some cases, the jamming signal source is co-located with a communications receiver that the user does not want jammed, as in the case of a military vehicle on patrol, or sited at a remote location.

Collocation of antennas can cause a received communication signal to be degraded by the transmit energy of a neighboring jammer. This degradation can result in a significant reduction in the communication range or data rate of the radios. The interference can sometimes be mitigated by separating the antennas by enough space to increase the free space losses of transmit power between the associated antennas, or to operate communications at frequencies not used by the jamming transmitter. At many frequencies the distance necessary to accomplish the required isolation is not feasible and the crosstalk interference can greatly diminish the performance. It is also often desirable to jam communications of others operating in essentially the same frequency bands as one's own communications, making isolation by frequency difficult.

Limited spaces such as in a submarine or other confined spaces requires co-location of phased array apertures in a single antenna enclosure. In such an environment, cross interference of transmitters and receivers can become a significant issue, degrading communication and radar capabilities. Extraneous transmitter leakage signals reduce the Signal-to-Noise Ratio (SNR) of the receive channels, affecting their range of operation, data rate, or creating false targets in the radars. In extreme cases involving high power transmitters the receivers can saturate and lose their sensitivity or can be damaged by the leaking transmit signals. Conventional isolation methods, such as creating radio frequency barriers between antennas, forming nulls in the antenna patterns, separating the antennas, reducing reflections from the radome and other nearby objects, require complex system modeling or empirical trial and error testing and may not be flexible enough to adjust when the interference environment changes.

What is needed is a system permitting long-range radio communications in the presence of a co-located high power jammer or other radio transmitter that is operating in a frequency band overlapping the communications transmit/receive band.

SUMMARY OF THE INVENTION

The present invention provides radio system providing long-range radio communications in the presence of a co-located high power jammer or other radio transmitter that is operating in a frequency band overlapping the communications transmit/receive band. The system collects sample signals from co-located overlapping radio. It down-converts the sample signal and the receive radio signal, digitizes the two signals, and utilizes a computer processor to cancel the sample signal from the receive radio signal to output a mitigated output signal.

In preferred embodiments the system permits the operator to maintain long range communications with friendly forces while concurrently suppressing all radio frequency receivers at a short to medium range. The system is designed to perform high precision cancellation of the jammer signal at a co-sited receiver by using precision analog/digital signal digitizers and an embedded digital processor. The system has been shown to achieve greater than 60 dB isolation between jammer and receiver in combination with other measures, which is a significant improvement over currently existing alternatives.

In preferred embodiments the radio of the present invention is co-located with a number of radios and samples of each of the co-located radio transmitters are obtained down converted and digitized for analysis by the computer processor. When a single antenna is used by the radio and a jammer the system may include primary isolation circuit which may be an analog circuit. The digital computer processor preferably is programmed to perform fast Fourier transforms on the first and second digitized radio signals, to calculate a signal spectra and to store it in memory. The processor then utilizes the stored transfer function to cancel the signal received at the first port from the signal received at the second port and to perform an inverse Fourier transform on the result to provide the mitigated receive signal.

DETAILED DESCRIPTION OF PREFERRED EMBODIMENTS

Figure 1:
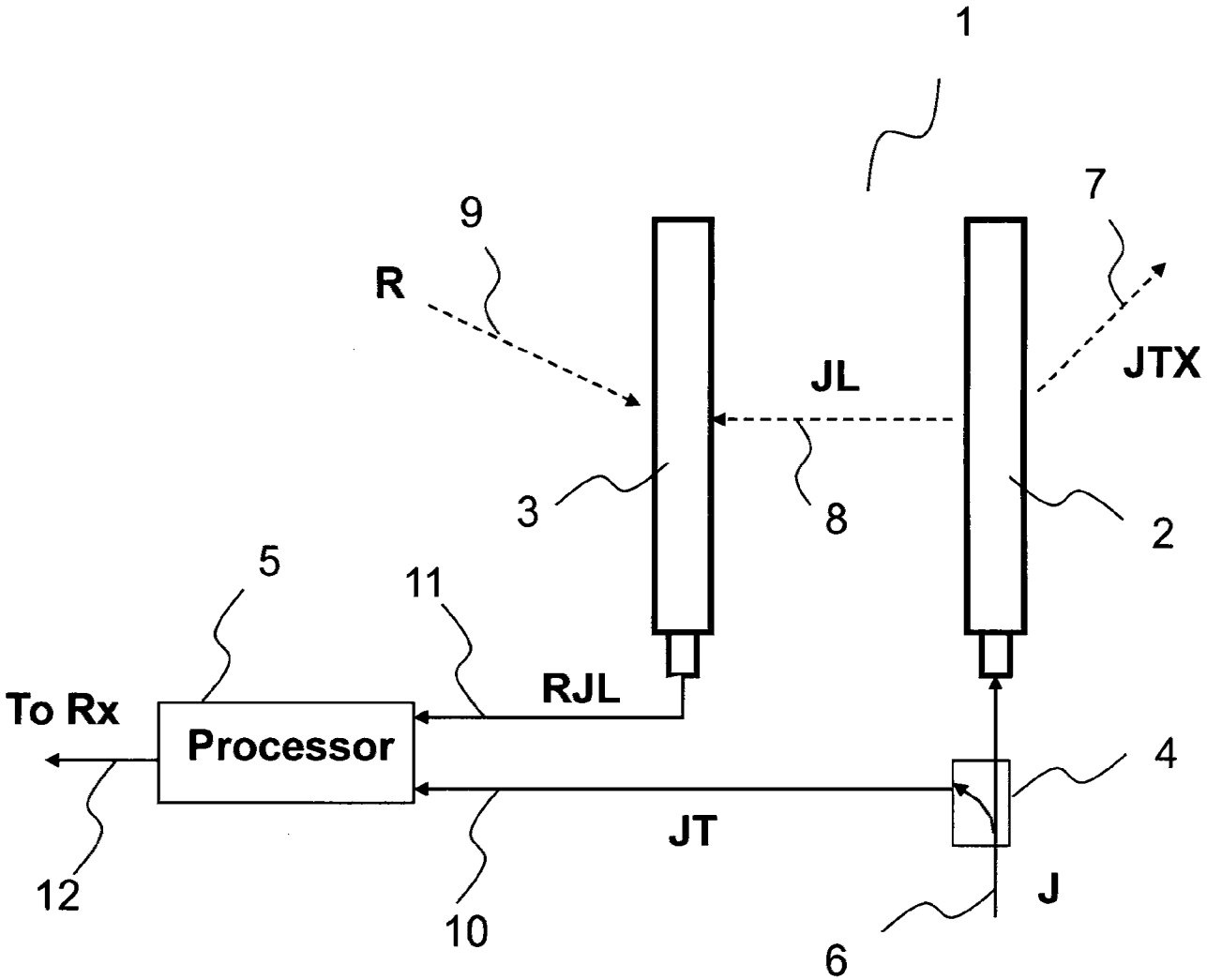
FIG. 1 is a diagram of a first preferred embodiment for operating separate antennas for communication and jamming.

An outline of a first preferred embodiment 1 of the present invention is shown in FIG. 1. The figure shows two separate antennas, 2 and 3. Antenna 3 is dedicated solely for communication and the other antenna 2 is dedicated solely for jamming. A small fraction of the input jammer signal J shown at 6 is tapped off in a coupler 4, whereas most of the jammer signal propagates to the antenna 2 where it is transmitted out at 7. The tapped signal 10, designated as JT, enters one port of the processor 5 where it is down converted, digitized and co-processed with the receive signal entering the second port of the processor. A portion of the transmitted jammer signal 8, designated as JL, is intercepted by the communication antenna 3. It combines with the communication signal R shown at 9 and the combined signal 11, designated as RJL, enters the second port of the processor 5. Processor 5 performs cancellation of the jammer leakage component in the receiver signal and provides clean receive signal 12 to the operator.

Figure 2:
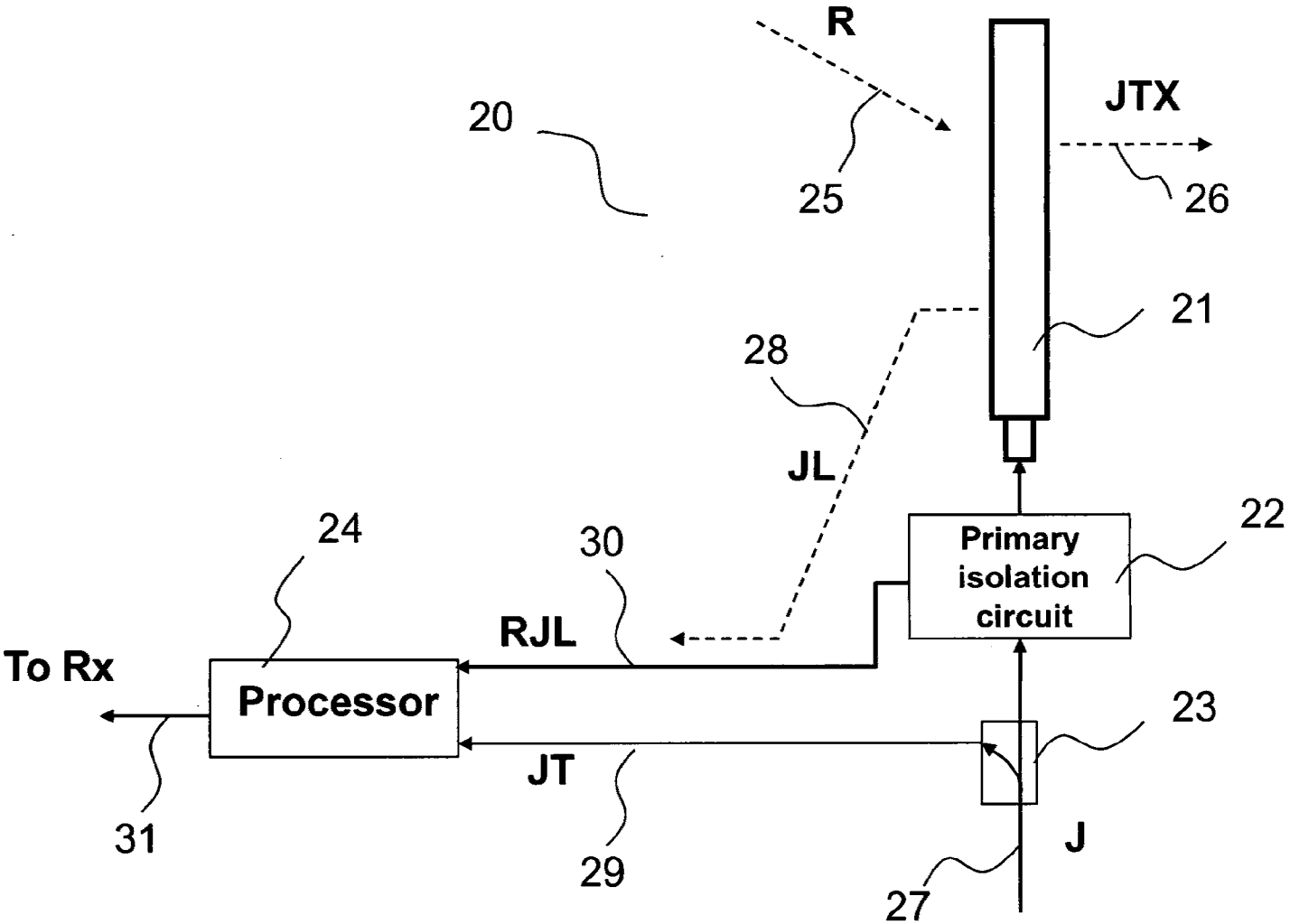
FIG. 2 is a diagram of a second preferred embodiment for operating common antenna for communication and jamming.

FIG. 2 outlines a second preferred embodiment 20 of the present invention using common antenna 21 for communication and jamming. Similar to the first preferred embodiment, a small fraction of the signal J shown at 27 from a high power jammer is tapped off in a coupler 23 whereas most of the jammer signal propagates to the antenna 21 through a primary isolation circuit 22 where it is transmitted out 26. Due to imperfect matching of the antenna circuit a portion 28 of the jammer signal, designated as JL, couples into the receiver. Considering the high power of the jammer signal, this leakage can render communication impossible and potentially damage the receiver front-end components. A broadband primary isolation circuit 22 is deployed to protect the receiver, although, due to its limited isolation capacity, a residual leakage of the jammer signal may still interfere with the radio communication. To further improve isolation between the receiver and jammer combined residual jammer and communication signal 30, designated as RJL, is collected at one port of the processor 24, whereas tapped jammer signal 29, designated as JT, is collected at its another port. Signals from both ports are independently down converted, digitized and then co-processed to extract clean receive signal 31.

Primary Isolation Circuit

Figure 10A:
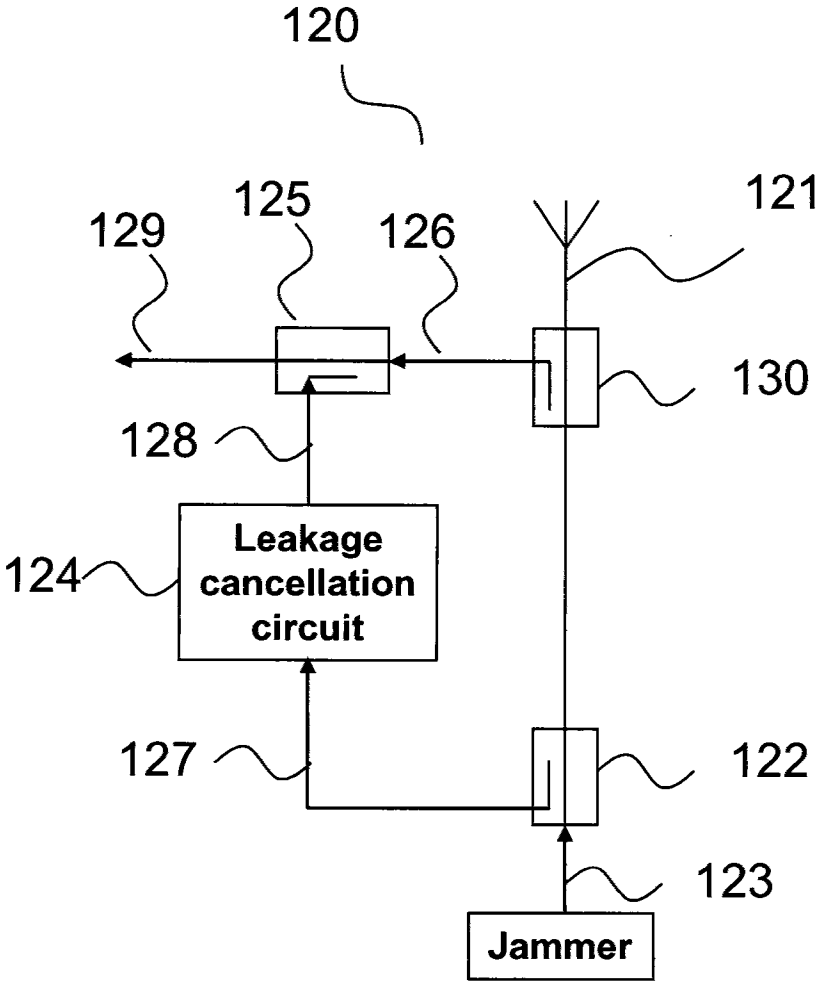
FIG. 10A is a diagram of the primary jammer leakage cancellation circuit.
Figure 10B:
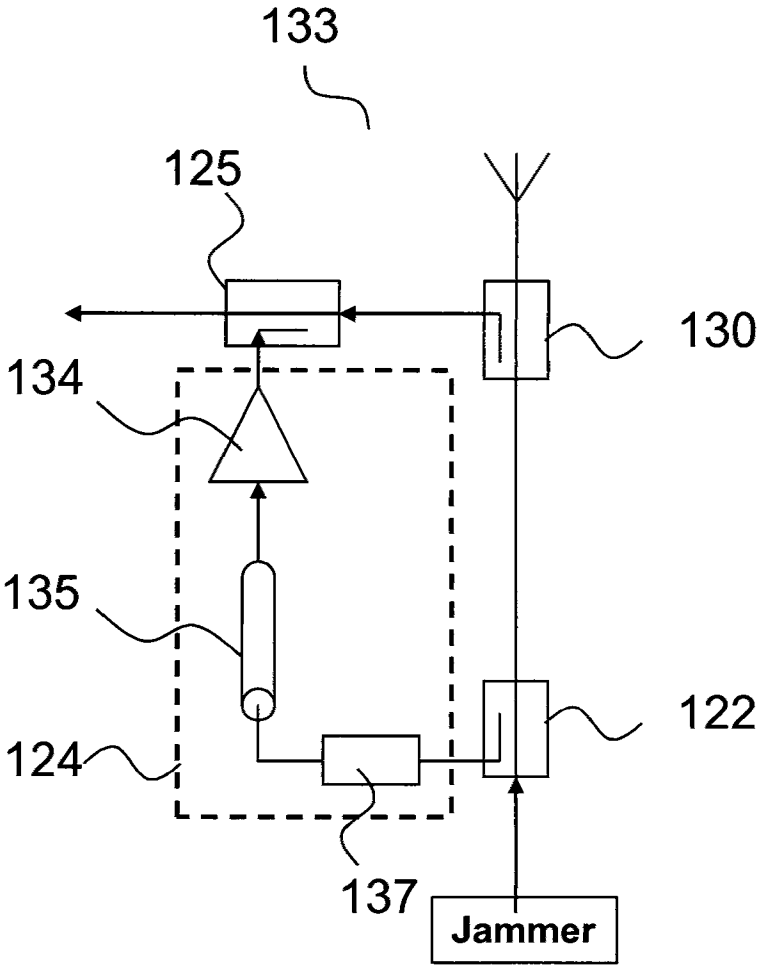
FIG. 10B is a diagram of a narrowband implementation of the primary leakage cancellation circuit.

FIG. 10A and FIG. 10B show a primary circuit configuration used in the second preferred embodiment of this preferred embodiment. A directional coupler 130 is used to connect receiver and jammer to a common antenna 121. In order to cancel out the jammer signal 126 reflected from the antenna into the receiver, a small fraction 127 of the signal from the jammer source 123 is tapped off using coupler 122. The tapped signal passes through a leakage cancellation circuit 124 where its phase and amplitude are transformed such that when the output signal 128 from circuit 124 is injected into the receiver through a directional coupler 125 it cancels out signal 126 leaking from the jammer. As a result, receive signal 129 contains significantly reduced jammer signal component.

Design of the leakage cancellation circuit 124 requires knowledge of the transfer function between jammer to receiver. The function can be accurately measured using microwave vector network analyzers such as Agilent Model 8720ES. Once the transfer characteristics of the leakage channel from jammer to receiver is measured, a leakage cancellation circuit effective in the narrow or broad frequency bands can be designed. Circuit performance can be optimized using commercial software such as Microwave Office by AWR Corporation.

A narrowband embodiment of the primary isolation circuit is shown in FIG. 10B. Components of the leakage cancellation circuit 124 include an attenuator 137, an amplifier 134 and a delay line 135. Attenuator and amplifier define magnitude of the leakage cancelling signal injected into the receiver and the delay line defines its phase. Amplifier may not be necessary if jammer signal leaking into the receiver has sufficiently high power and can be cancelled without amplification in the cancellation circuit.

An individual experienced in the art of radio frequency engineering can design more complex circuit that provides high level of cancellation over a wide frequency band.

Figure 3:
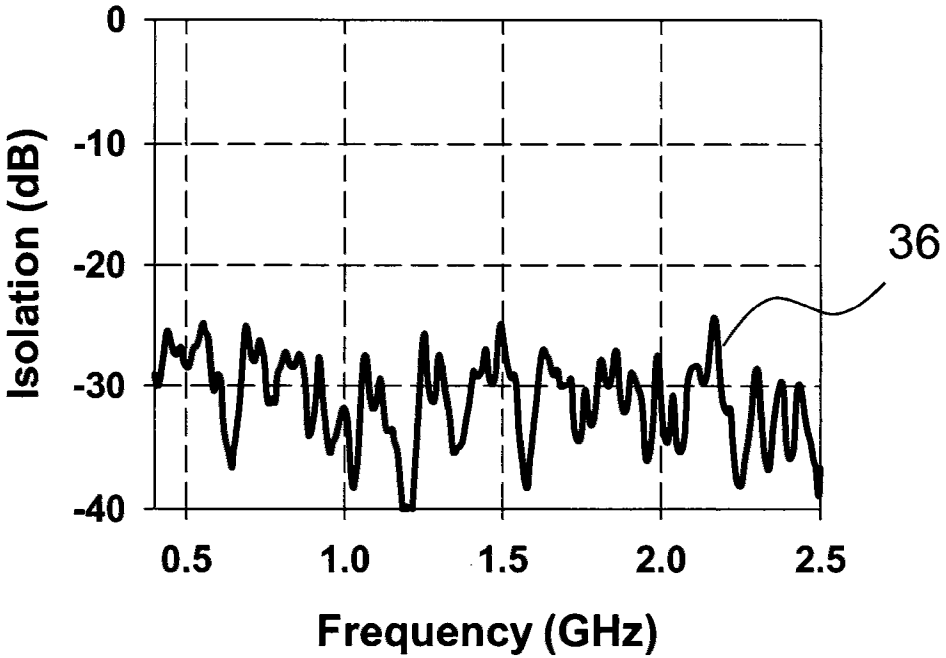
FIG. 3 shows an example of broadband isolation data of the primary isolation circuit used with common antenna for jamming and communication.

An example of receiver-jammer isolation characteristics 36 achieved with the primary isolation circuit described in FIG. 10B is shown in FIG. 3

Radio Frequency Circuits

Figure 4:
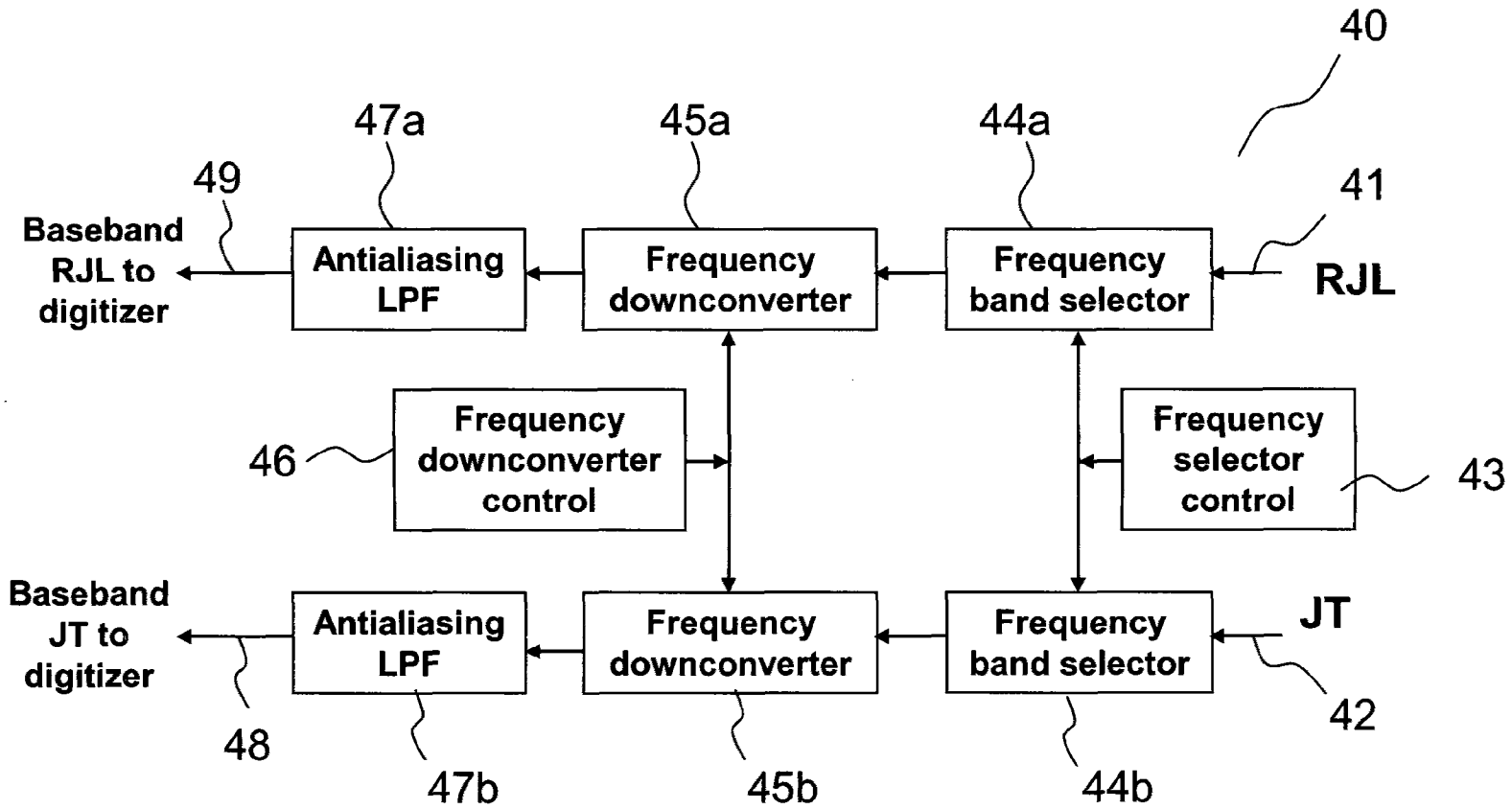
FIG. 4 is a diagram of a circuit for selection of a desired communication band at RF frequencies and down conversion of signals for digitizing.

Embodiments of the present invention utilize digital processing to remove jammer signal leaking into the receiver. High speed and high resolution digitizers are required to accurately represent signals within bandwidth of the receiver. Low cost commercial digitizers, such as made by Analog Devices and Texas Instruments (ADS5474), have data sampling rate of several hundred million samples per second (MSPS), which limits bandwidth of the digitized signals to a few hundred megahertz. Radio frequency signals have to be down converted to sufficiently low frequencies in order to be digitized at these acquisition rates without distortion. A frequency band selection and down conversion circuit is used in both of the above preferred embodiments in order to address the above bandwidth constrictions. Block diagram of the preferred embodiment 40 of such circuit is shown in FIG. 4. Similar frequency circuit architectures are used to process receive RJL signal 41 and signal jammer tap signal JT 42. Tunable frequency selectors, one each for the receive 44*a* and for the tapped 44*b* RF signals, limit RF signals bandwidth near a pre-selected center frequency. The center frequency of the band selector is set by a frequency control module 43. From selectors 44*a* and 44*b* the band limited RF signals enter frequency down conversion modules 45*a* and 45*b* controlled by the frequency down conversion control module 46. The output of the frequency down converters provides low frequency baseband receive signal which can be digitized without aliasing distortion. High frequency down conversion byproducts are removed by the anti-aliasing low pass filters 47*a*) and 47*b*. Down converted and conditioned receive RJL 49 and tapped jammer JT 48 signals are sent to the analog to digital conversion modules for digitizing.

Figure 5:
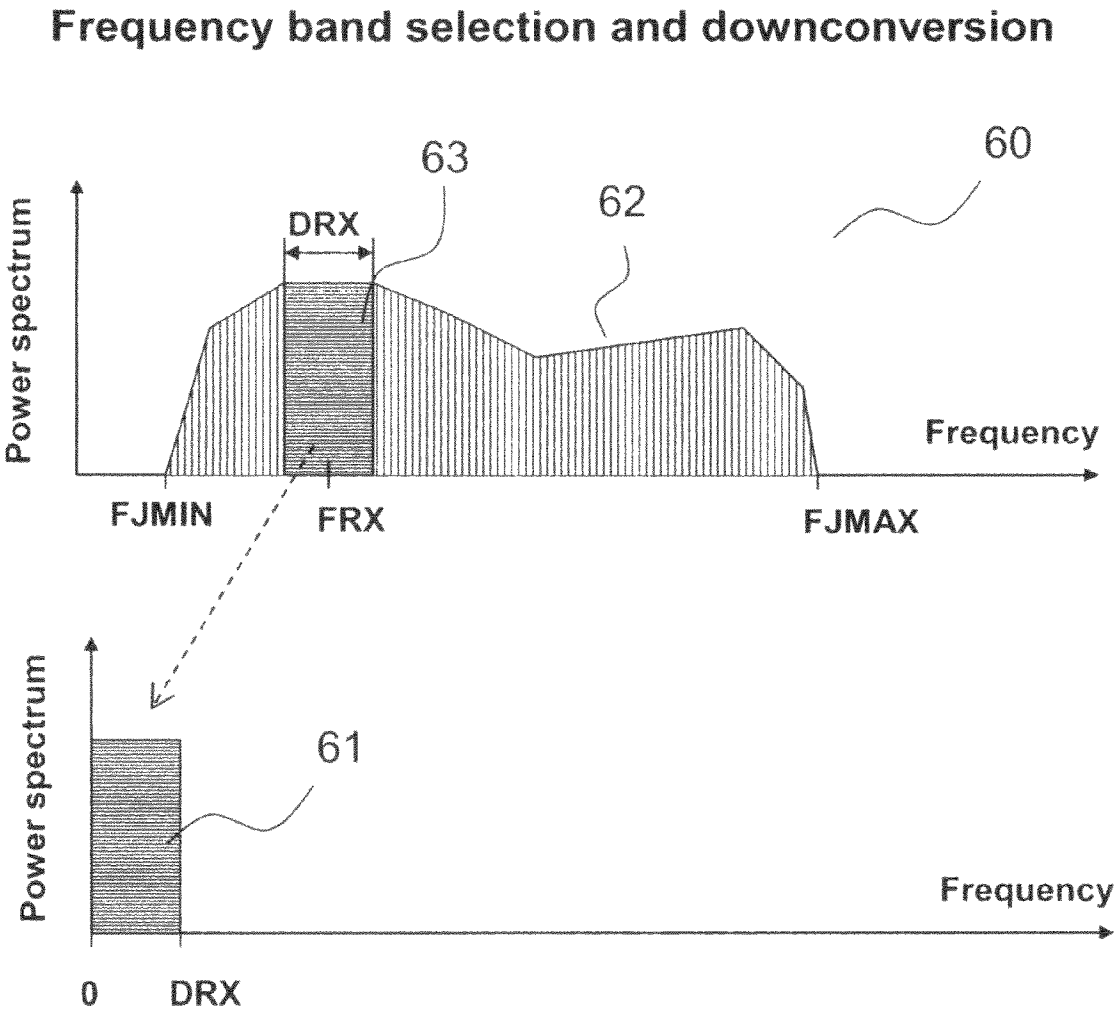
FIG. 5 is a diagram illustrating spectral selection and down conversion of the desired RF signals performed by the circuit shown in FIG. 4.

FIG. 5 illustrates RF signal conversions in the frequency domain. Radio frequency spectrum 60 represents a combination of a relatively narrowband receive signal 63 and a relatively broadband jammer signal 62. The receive signal 63 is centered near a center frequency designated as FRX and occupies a bandwidth designated as DRX. Jammer signal occupies frequency band between frequencies FJMIN and FJMAX. The band selection circuits 44*a* and 44*b* pass only signals within the receive band 63 and reject signals at all other frequencies. Frequency down conversion circuits 45*a* and 45*b* translate spectrum of the receive signal 63 to baseband 61 located between zero (DC) and (DRX) frequencies where they become suitable for digitizing.

Figure 6A:
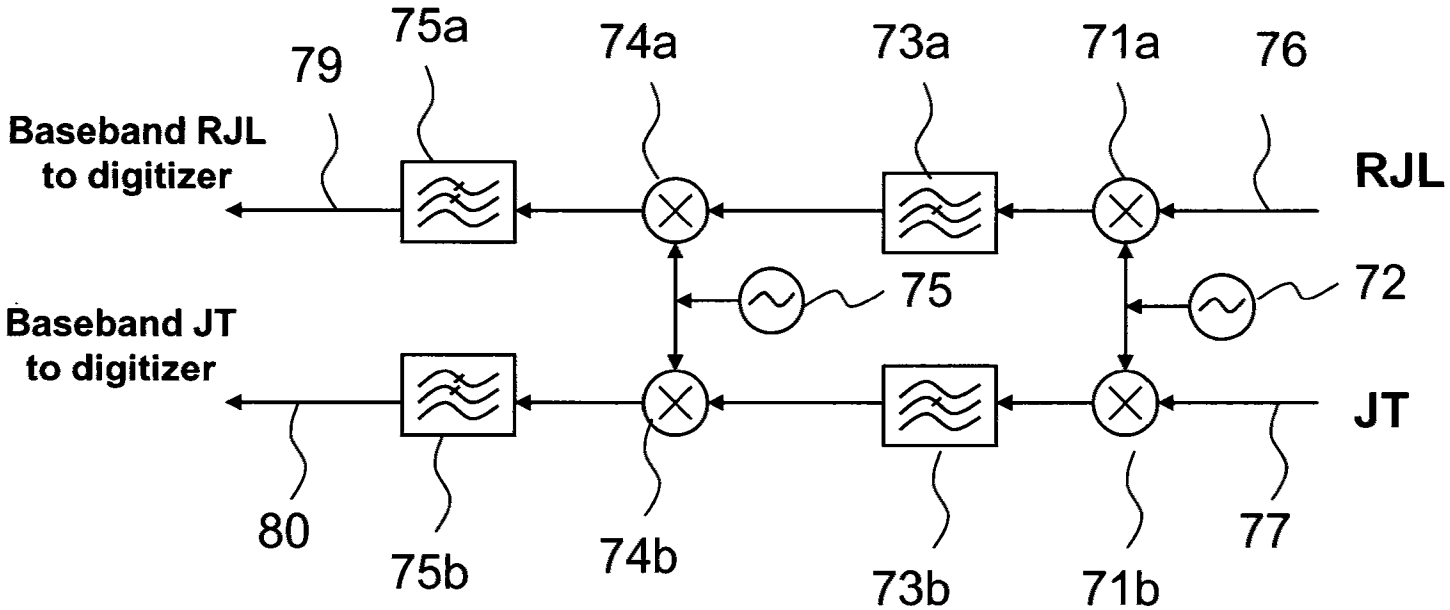
FIG. 6A is a first circuit diagram of the preferred embodiment shown in FIG. 4.

A first preferred band selection and down conversion circuit is shown in FIG. 6A. Frequency band selection is performed by frequency mixers 71*a* and 71*b* with local oscillator input from a programmable continuous wave CW RF source 72. The frequency variable source and its programming circuitry perform frequency selector control function 63), whereas mixers 71*a*, 71*b* and identical fixed band pass filters 73*a* and 73*b* act as frequency band selectors. When local oscillator frequency varies, the spectrum of RJL and JT signals is shifted in frequency relative to the fixed pass band of the filters 73*a* and 73*b* allowing only a portion of the spectrum that contains communication signals to pass through the filters to the mixers 74*a* and 74*b*. Frequency mixers 74*a* and 74*b* perform frequency down conversion shown as 45*a* and 45*b* in FIG. 4. A single frequency RF source 75 provides local oscillator input to the mixers. Anti aliasing low pass filters 75*a* and 75*b* remove baseband noise and high order down conversion products from signals 79 and 80 before they enter the digitizers. It is important to maintain coherence of the jammer component in the receive and tapped signals which is accomplished by using common local oscillators 72 and 75 in the band selection and down conversion chains. Other details of the circuit connections include:

1) RJL and JT signals enter intermediate frequency (IF) ports of the their respective mixers 71*a* and 71*b;*
2) Radio frequency ports of mixers 71*a* and 71*b* connect to their respective band pass filters 73*a* and 73*b;*
3) Opposing ends of the band pass filters connect to the RF ports of the down converting mixers 74*a* and 74*b;*
4) IF outputs of the down converting mixers connect to the anti aliasing filters 75*a* and 75*b.*

In systems operating between 100 MHz and 2.5 GHz the following parts can be used: Mini-Circuits model ZX05-83-S+ as 71*a* and 71*b* mixers, K&L Microwave model 7B250-1500/T90-0/0 as 73*a* and 73*b* bandpass filters, Mini-Circuit model ZX05-42 MH-S+ as 75*a* and 75*b* mixers, Mini-Circuits Model SLP-90+ as 75*a* and 75*b*) low-pass filters, Texas Instruments model ADS62P49 dual channel 250 MSPS 14-bit analog to digital converter as RJL and JT signal digitizer, CTI/Herley PDRO operating at 1450 MHz as fixed local oscillator 75 and an RF generator model SSG10/4000 manufactured by dBm LLC as variable frequency local oscillator 72.

Figure 6B:
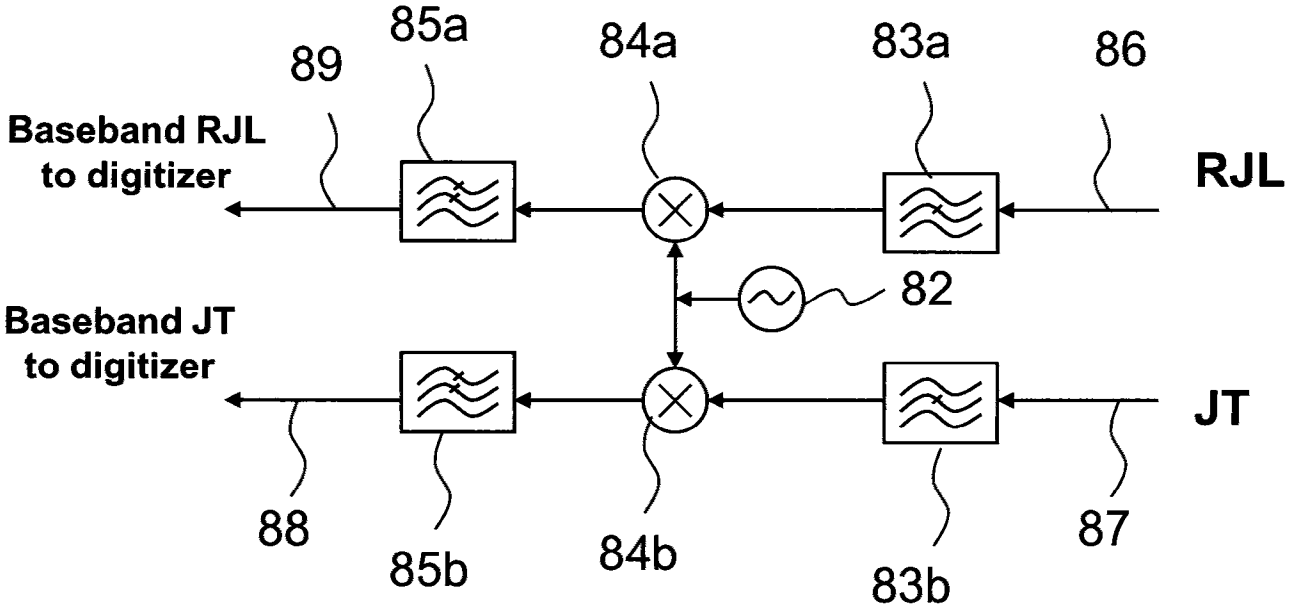
FIG. 6B is a second circuit diagram of the preferred embodiment shown in FIG. 4.

A second preferred embodiment of the band selection and down conversion circuit shown in FIG. 6B represents a simplified version of the circuit in FIG. 6A. This embodiment uses fixed frequency band selectors tuned to a specific receive band. Band selection in the RJL and JT signal channels is accomplished by two identical bandpass filters 83*a* and 83*b*. Mixers 84*a* and 84*b* down convert preselected signals to the baseband and anti aliasing filters 85*a* and 85*b* remove high order frequency conversion components and noise. Conversion processes is controlled by a local oscillator 82 common to both mixers, which ensures coherence of the signals in the two channels. Parts similar to the listed above can be used to build a working circuit but bandpass filters 83*a* and 83*b* have to be centered at the receive RF frequency of interest and frequency of the local oscillator 82 has to be selected to ensure that the receive signal is down-converted to the baseband that can be digitized without distortion.

Digitizing and Processing Circuits

Figure 7:
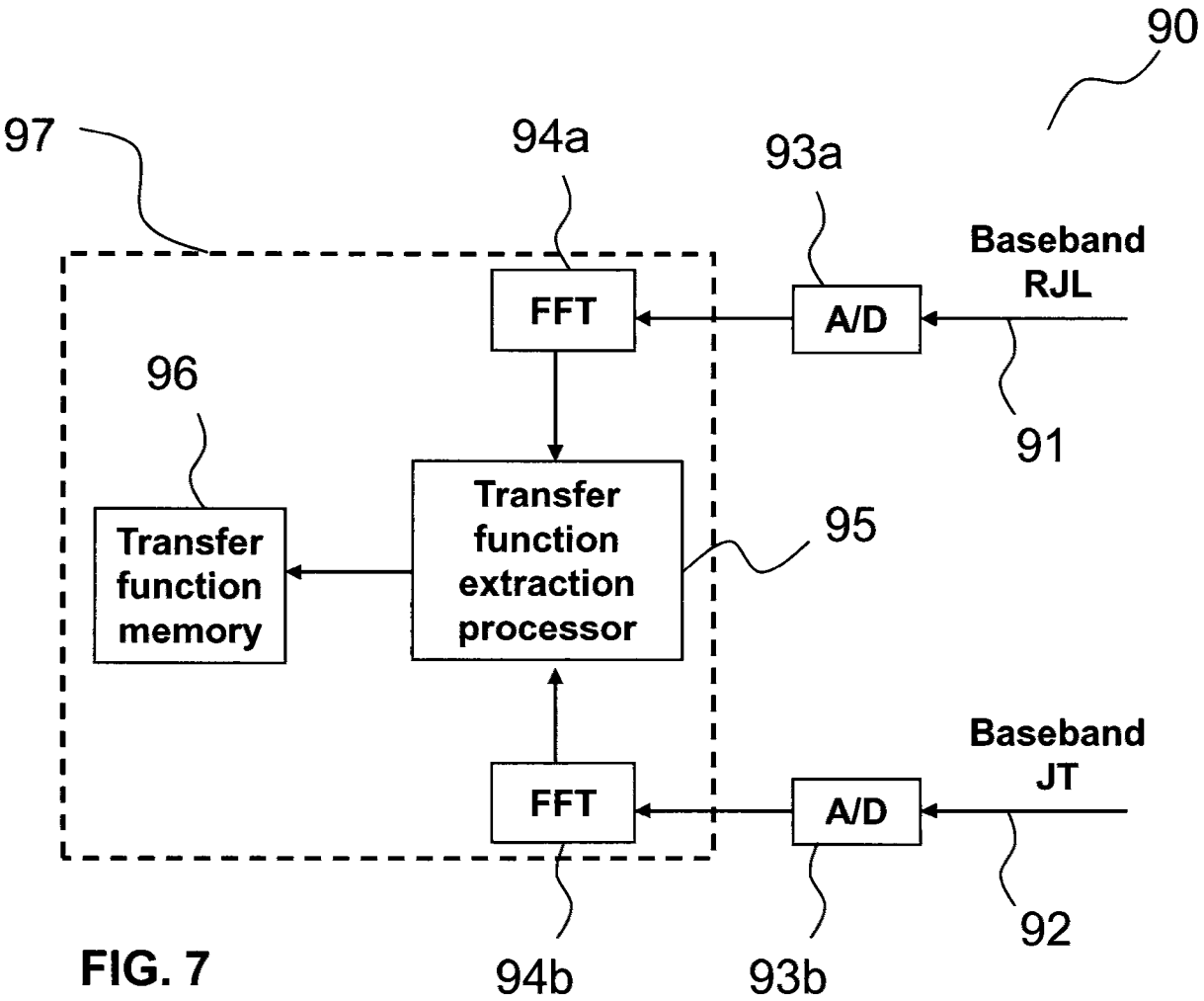
FIG. 7 is a block diagram showing data acquisition and processing components for extracting signal transfer function of the jammer leakage channel.
Figure 8:
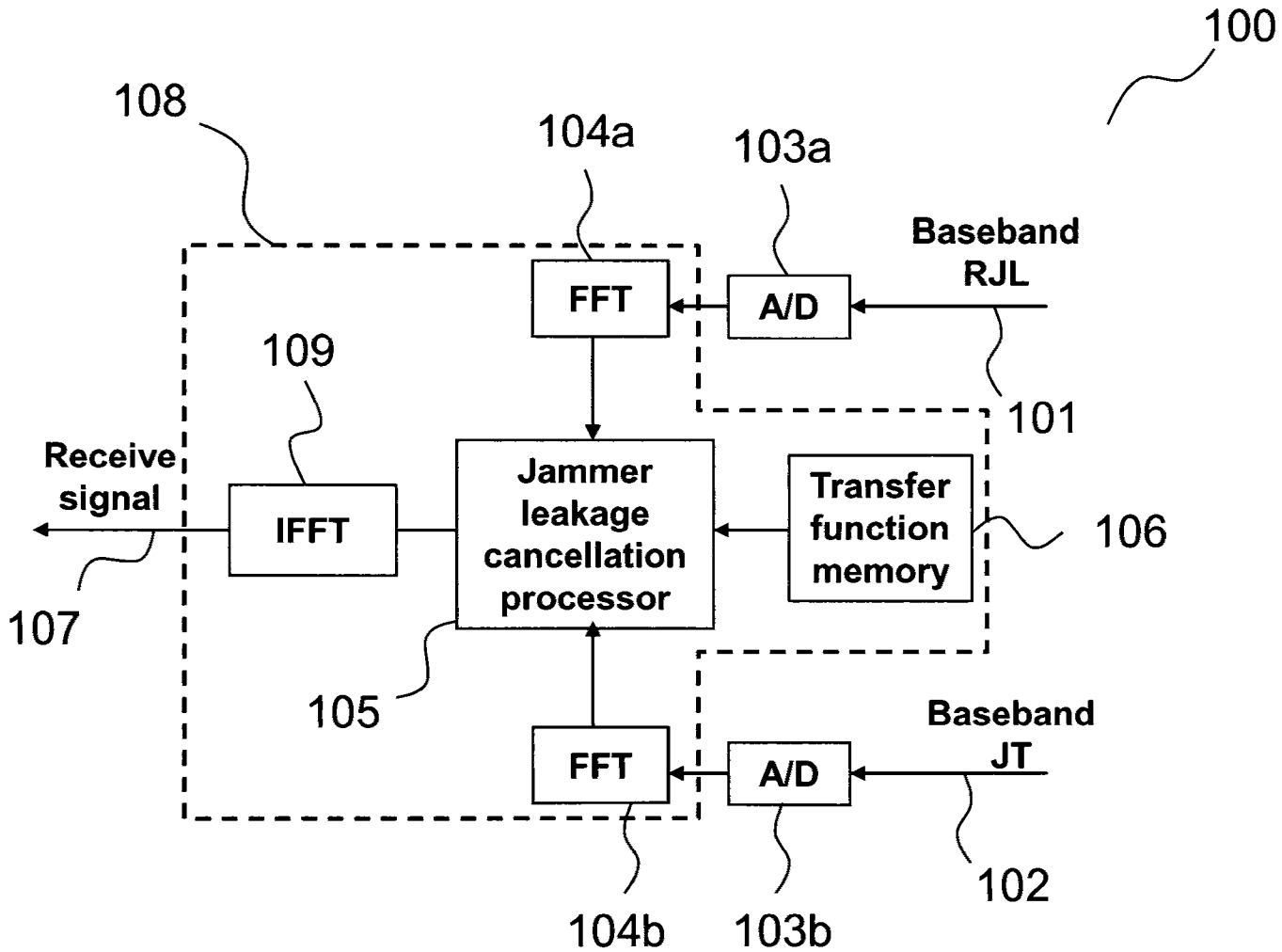
FIG. 8 is a block diagram showing data acquisition and processing components used for digital cancellation of jammer leakage signal from the receiver signal.

Block diagrams of the dual channel digitizing and processing circuit for the jammer leakage cancellation is shown in FIG. 7 and FIG. 8. The circuit is reconfigurable using an embedded processor shown as 97 in FIG. 7 and as (108) in FIG. 8. The embedded data processor can be configured either to extract transfer function of the system circuitry or to perform continuous jammer leakage cancellation. In cases where cost is not a limiting factor, separate processors operating in parallel can be used instead. The system incorporates two high resolution analog to digital converters, where one converter 93*a* digitizes the baseband receive signal in the RJL channel 91 and the other 93*b* digitizes the tapped jammer signal in the JT channel 92. When the processor is configured for estimating the transfer function of the system as shown in FIG. 7, the digitized signals undergo Fast Fourier Transform (FFT) in modules 94*a* and 94*b* before entering the processor 95 for computations. The resulting transfer function is stored in the memory 96. When the processor is configured for cancellation of the jammer leakage (as shown in FIG. 8, an estimated transfer function from memory 106 is co-processed with the real time Fourier spectra of the signals to remove jammer component in the receive signal. Spectral data then converted into the time domain in the module 109 using inverse FFT transform and clean receive signal 107 is provided to the operator.

Figure 9A:
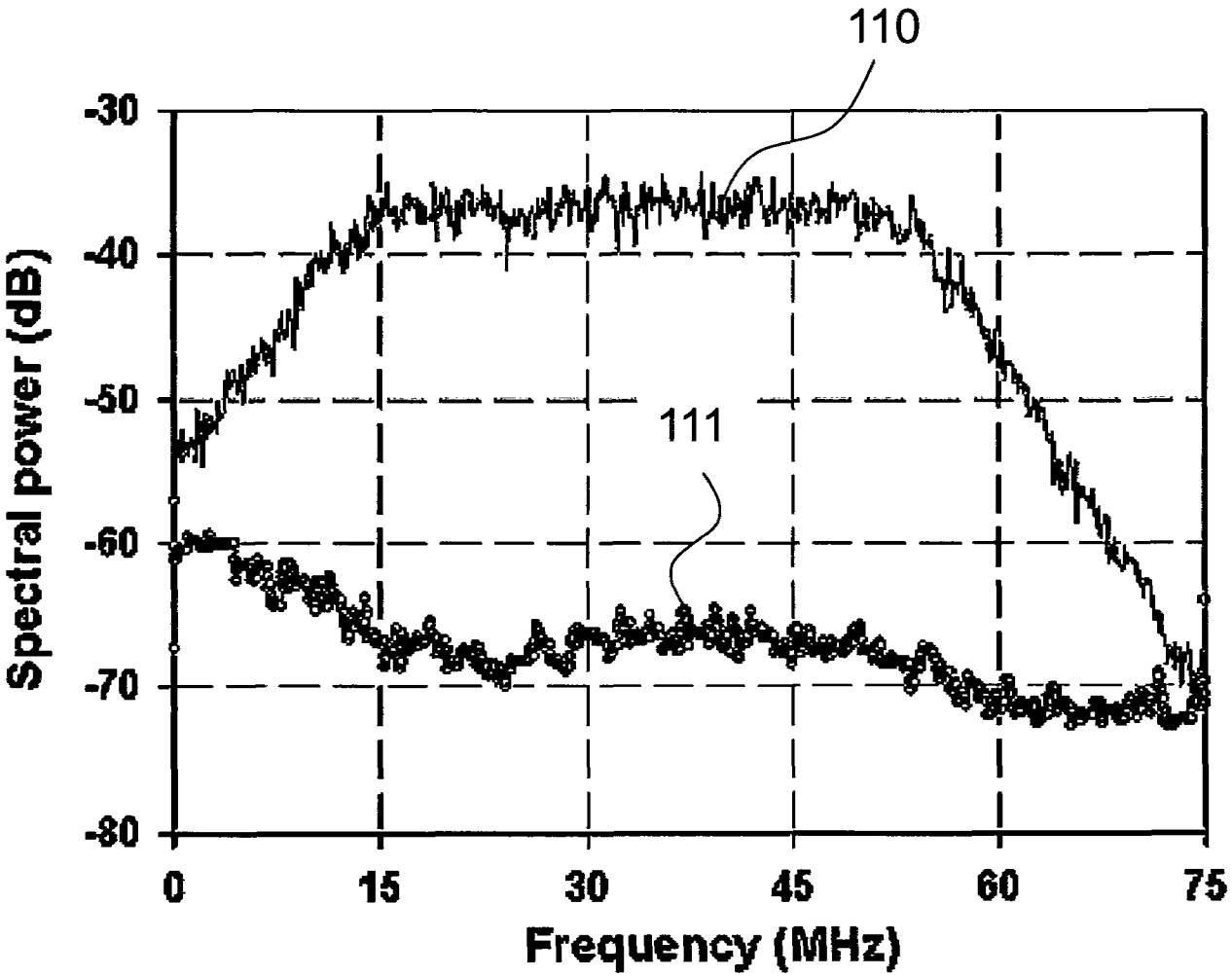
FIG. 9A is an example illustrating efficiency of the jammer leakage cancellation using the proposed system when receive signal is not present.
Figure 9B:
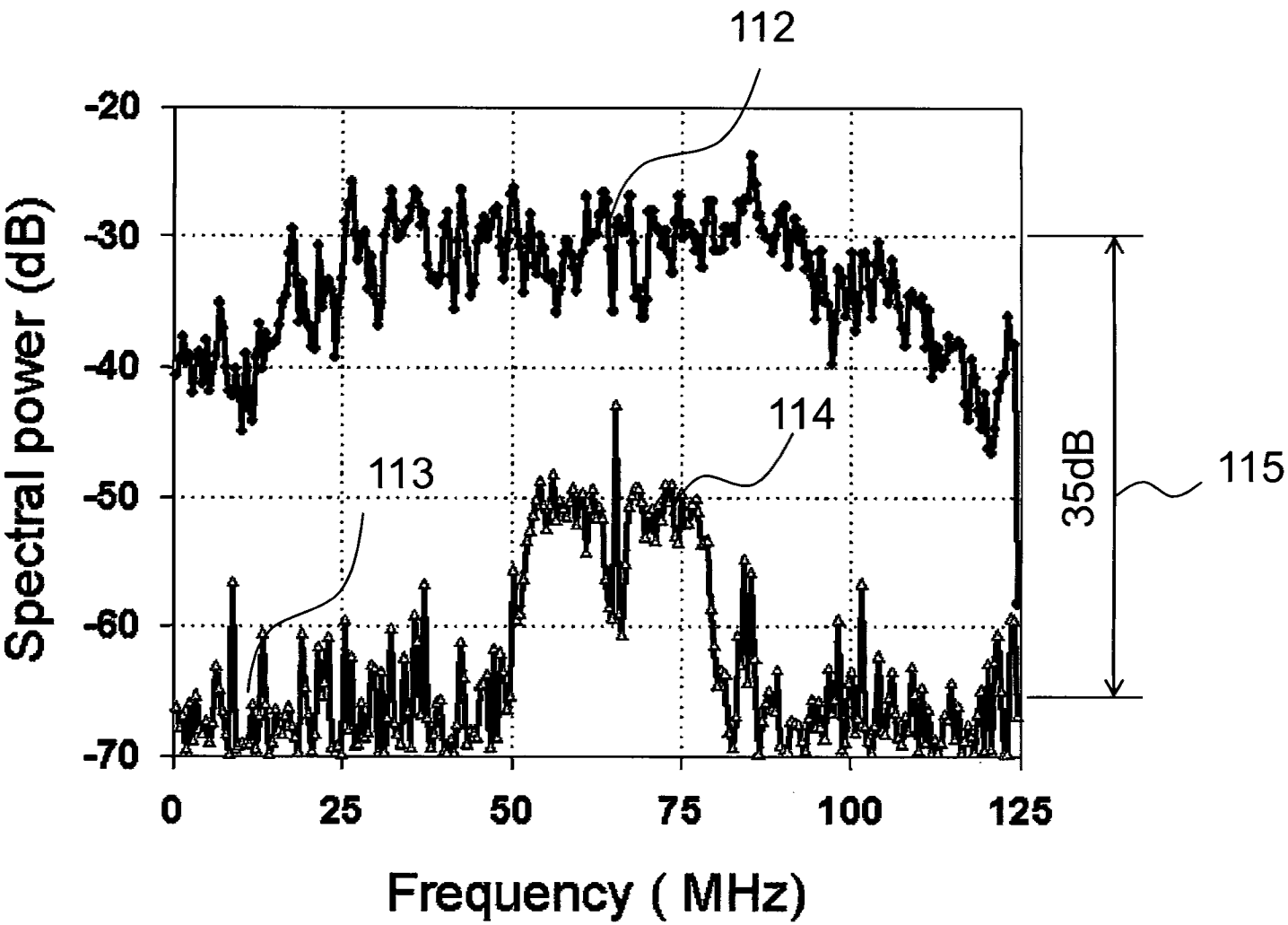
FIG. 9B is an example illustrating efficiency of the jammer leakage cancellation using the proposed system in the presence of the receive signal.

An efficiency of the digital cancellation of the jammer leakage is illustrated in FIG. 9A and FIG. 9B. Data in FIG. 9A corresponds to a case when antenna is isolated and does not receive external signals. The only signals present are from the jammer. Trace 110 shows spectral power of the leaking jammer signal into the receiver before cancellation. Trace 111 shows residual spectral power of the leaking signal after digital cancellation. Data in FIG. 9B was collected after antenna was allowed to receive external communication signals. Jammer leakage cancellation processes deployed previously estimated and save transfer function. Without digital isolation the communication signal 114 was completely buried under a high power jammer signal 112. Digital processing reduced spectral power of the leaking jammer signal by approximately 35 dB 115 and allowed the communication signal to be detected. Residual jammer leakage component level is shown as 113.

Signal Processing Algorithm

Figure 11:
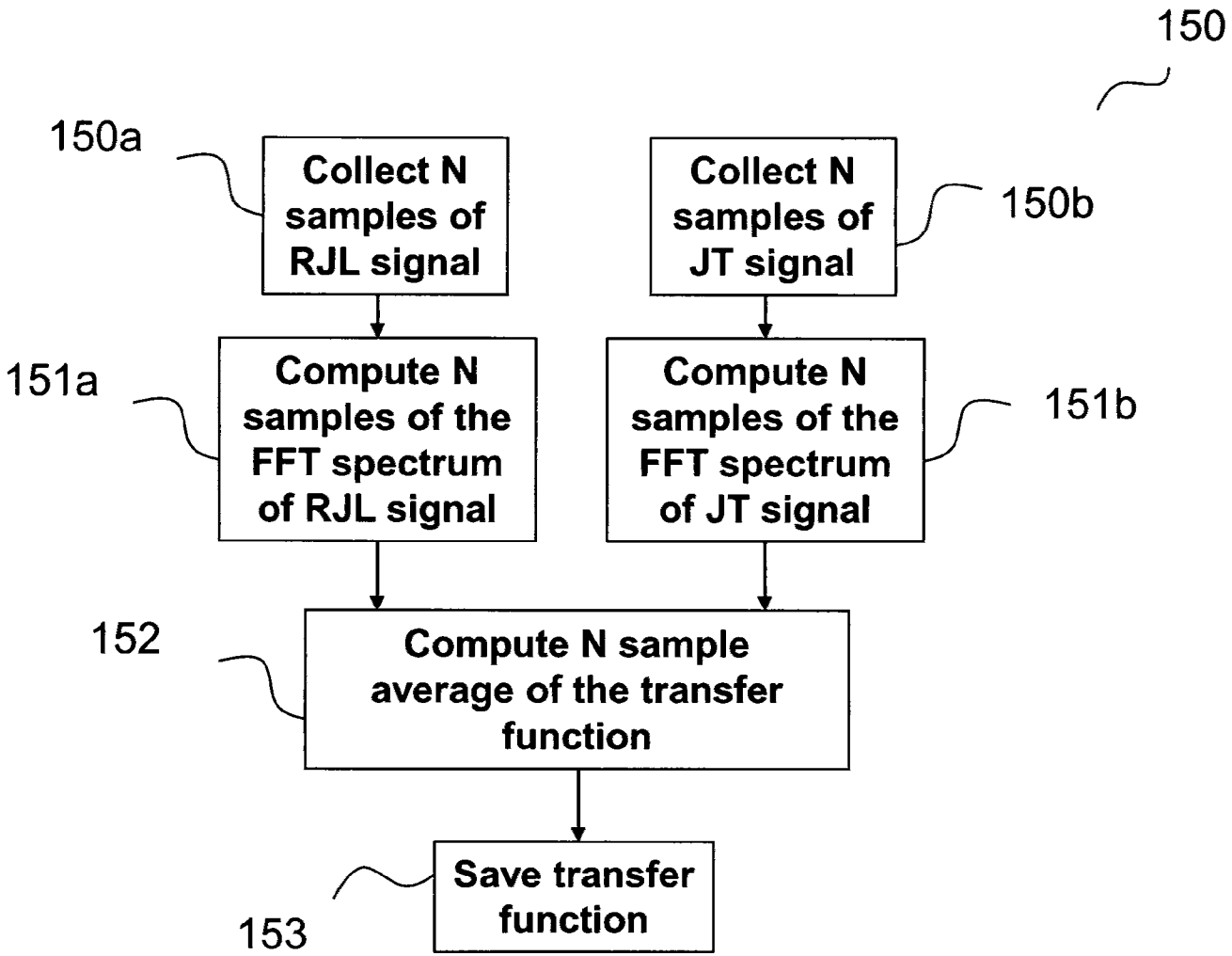
FIG. 11 is a flow chart of a process for evaluation of the leakage channel transfer function between jammer and receiver.
Figure 12:
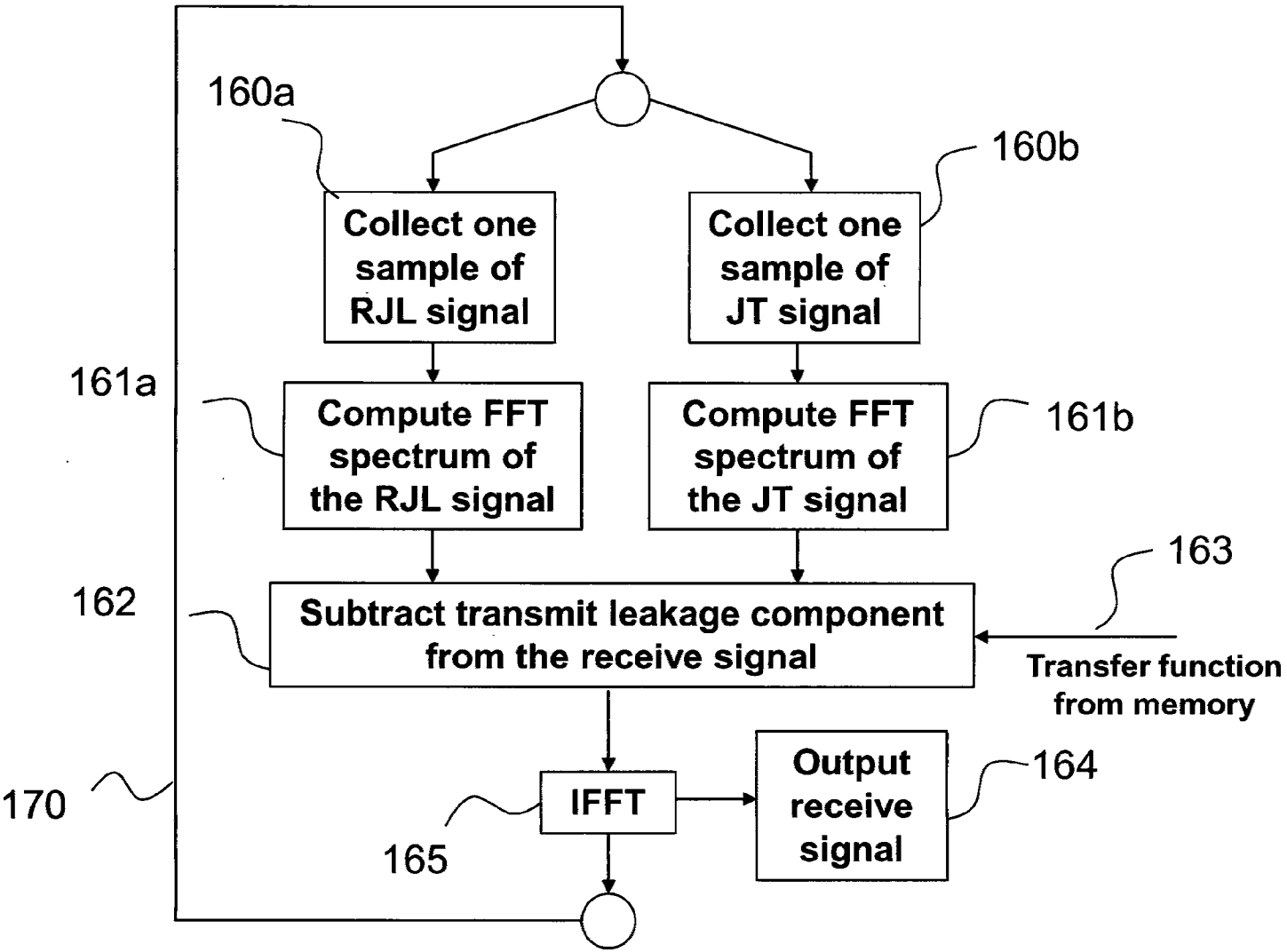
FIG. 12 is a flow chart of a process for cancellation of the jammer leakage component from the receive signal.

Flow charts for the digital interference cancellation algorithm are shown in FIG. 11 and FIG. 12. Cancellation process uses digitized signals and comprises two steps. At the first step the transfer function of the jammer leakage channel is estimated and saved in order to be used at the second step. The process starts by simultaneously digitizing signals in the RJL (150*a*) and JT (150*b*) channels and collecting N data samples for each channel. In the preferred embodiment each sample contains 4096 data points and the number (N) of the collected samples is one hundred. At a sampling rate of 400 MSPS the entire data collection process takes approximately one millisecond. Then complex FFT spectra are computed for each of the 4096 data point sample in blocks (151*a*) and (151*b*). An estimate of the transfer function H(f) is computed for concurrent FFT spectra in the RJL and JT channels as follows:

$$H(f) = \frac{FFTRJL(f)}{FFTJT(f)} \tag{1}$$

Where f—stands for frequency, FFTRJL(f) is complex FFT spectrum of the RJL signal and FFTJT(f) is the FFT spectrum of JT signal collected at the same time as the RGL signal.

An average of the N=100 transfer function estimates is then computed in block 152 and saved in the block 153. To minimize distortion of the function estimate by inputs from external sources it is preferable to isolate the antenna during the first step procedure. Another option is transmitting high power jammer signal such that its leaking component is significantly higher than other interfering receive signals and noise. It was experimentally confirmed that the latter option works well with a high power jammer. Alternately to the described above the transfer function estimation and update can take place in parallel with the cancellation procedure using separate processors. This will permit continuous maintenance of high isolation between receiver and jammer by using most current transfer function estimates.

The second (cancellation) step of the process as shown in FIG. 12 is performed in real time using high speed processor implemented in FPGA or similar device. Signal acquisition and processing is performed in an infinite loop 170. Each cycle starts by collecting of 4096 signal samples from the RJL 160*a* and JT 160*b* channels followed by computing FFT spectrum of each sample 161*a*, 161*b*. Previously estimated and saved transfer function 163 is used to reduce jammer leakage component in the output receive signal FFTRx(f) as follows:

$$\mathrm{FFTRx}(f)=\mathrm{FFTRJL}(f)-\mathrm{FFTJT}(f)\cdot H(f) \tag{2}$$

Where f is frequency, FFTRJL(f) and FFTJT(f) are concurrent FFT spectra of the RJL and JT signal samples.

Inverse FFT processing in block (165) converts clean receive signal FFTRx(f) from frequency to time domain and outputs it to the radio operator in block (164).

A second preferred embodiment of the algorithm is deployed for evaluation of the transfer function in the presence of strong external interference signals. It is assumed that the external interference signals do not correlate with the jammer signal. This approach also requires an a priori knowledge of the complex transfer function H1(*f*) between jammer to the tap port of the tapping coupler 23 shown in FIG. 2. The H1(*f*) function is also assumed not to vary with time. It can be measured with high precision using vector network analyzer such as Agilent 8720ES.

Under above conditions an estimate of the transfer function H2(*f*) of the jammer leakage channel can be computed as follows:

$$H2(f) = \frac{\langle FFTRJL(f)\cdot FFTJT(f)^*\rangle_N}{\langle FFTJT(f)\cdot FFTJT(f)^*\rangle_N}\cdot H1(f) \tag{3}$$

Where FFTRJL(f) and FFTJT(f) are complex FFT spectra of the concurrent RJL and JT signals; symbol * designates complex conjugate of the FFT spectra; and $<\ldots>_N$ stands for the mean value of N samples of an expression between angular parentheses. Using transfer function H2(*f*) the leaking jammer signal can be removed form the receive signal as follows:

$$FFTRx(f) = FFTRJL(f) - \frac{H2(f)}{H1(f)}\cdot FFTJT(f) \tag{4}$$

Complex spectrum FFTRx(f) of clean receiver signal is converted to the time domain using inverse FFT procedure as shown (165) in FIG. 12. The result is output to the radio operator (164).

While the present invention has been described in detail with respect to preferred embodiments, persons skilled in the radio arts will recognize that many changes and variations are possible within the general concepts of the present invention. For example, there can be any number of competing radio sources that need to be dealt with. As explained all of these competing sources can be sampled and subtracted out using the digital processes described above. In common antenna systems such as that shown in FIG. 2 the system may or may not include a primary analog isolation. The invention can be utilized in many situations, especially at locations such as antenna ranges, or on board ships, aircraft or other vehicles to reduce co-site interference. Therefore the scope of the invention should be determined by the appended claims and not the specific examples given above.

We claim:

1. A radio system defining a receive radio band and providing long-range radio communications with a second radio in the presence of at least one co-located overlapping radio, such as a jammer or other radio transmitter, that is operating in a frequency band overlapping the receive band said radio system comprising:

A) a radio transmitter;

B) a digital computer processor having a first port and a second port and programmed:

1) to receive a first digitized radio signal at a first port corresponding to a sample signal from the at least one co-located overlapping radio;

2) to receive a second digitized radio signal at a second port corresponding to a receive radio signal along with some leakage component of radio transmission from the jammer or other radio transmitter;

3) to cancel from the signal received at said second port, the signal received at said first port; and 4) to output a mitigated receive signal;

C) a first down-converter and a first digitizer said first down-converter being adapted to down convert a first radio signal to a lower frequency radio frequency and to transmit the lower frequency signal to the first digitizer, said first digitizer being adapted digitize said lower frequency signal and to transmit it to the first port of said digital computer, D) a second down-converter and a second digitizer said second down-converter being adapted to down convert a second radio signal to a lower frequency radio frequency and to transmit the lower frequency signal to the second digitizer, said second digitizer being adapted digitize the lower frequency signal and to transmit it to the second port of said digital computer, E) a sampling means for sampling transmit signals from at least one co-located overlapping radio and for transmitting the sampled signals to said first down converter; and F) an antenna system adapted to receive radio signals transmitted from said second radio within said receive radio band and for transmitting the radio signals to said first down converter; wherein the digital computer processor is also programmed with an algorithm adapted to estimate and store in a first step a complex transfer function associated with the co-located overlapping radio transmitter and in a second step to perform signal acquisition and processing using the saved complex transfer function to reduce the leakage component in the receive signal.

2. The radio system as in claim 1 wherein the at least one co-located overlapping radio is a jammer.

3. The radio system as in claim 1 wherein the at least one co-located overlapping radio includes a second radio transmitter.

4. The radio system as in claim 1 wherein the at least one co-located overlapping radio is a plurality of radios and sampling means is adapted to obtain signals from each of a plurality of radio transmitters and to communicate them to the said first down converter.

5. The radio system as in claim 1 wherein the radio systems includes a common antenna for communicating and jamming.

6. The radio system as in claim 1 wherein the radio system includes a primary isolation circuit.

7. The radio system as in claim 6 wherein the primary isolation circuit is an analog circuit.

8. The radio system as in claim 1 wherein the digital computer processor is programmed to perform fast Fourier transforms on the first and second digitized radio signals, to calculate the complex transfer function and to store it in memory.

9. The radio system as in claim 1 wherein the first digitized radio signal defines a leakage component and a leakage channel and wherein the digital computer processor is programmed to perform fast Fourier transforms on the first and second digitized radio signals, to calculate a transfer function of the leakage channel and to store it in memory.

10. The radio system as in claim 8 wherein the digital computer processor is further programmed to utilize the stored complex transfer function to cancel the signal received at the first port from the signal received at the second port and to perform an inverse Fourier transform on the result to provide the mitigated receive signal.

* * * * *